US010059575B2

(12) United States Patent
Ueda et al.

(10) Patent No.: US 10,059,575 B2
(45) Date of Patent: Aug. 28, 2018

(54) HYDRAULIC CONTROL DEVICE FOR FORKLIFT

(71) Applicant: KABUSHIKI KAISHA TOYOTA JIDOSHOKKI, Kariya-shi, Aichi-ken (JP)

(72) Inventors: Yuki Ueda, Kariya (JP); Tsutomu Matsuo, Kariya (JP); Takashi Uno, Kariya (JP); Hirohiko Ishikawa, Kariya (JP)

(73) Assignee: KABUSHIKI KAISHA TOYOTA JIDOSHOKKI, Kariya-shi, Aichi-ken (JP)

( * ) Notice: Subject to any disclaimer, the term of this patent is extended or adjusted under 35 U.S.C. 154(b) by 413 days.

(21) Appl. No.: 14/769,836

(22) PCT Filed: Feb. 12, 2014

(86) PCT No.: PCT/JP2014/053128
§ 371 (c)(1),
(2) Date: Aug. 24, 2015

(87) PCT Pub. No.: WO2014/132792
PCT Pub. Date: Sep. 4, 2014

(65) Prior Publication Data

US 2016/0002017 A1 Jan. 7, 2016

(30) Foreign Application Priority Data

Feb. 27, 2013 (JP) ..... 2013-037069

(51) Int. Cl.
*B66F 9/22* (2006.01)

(52) U.S. Cl.
CPC ..... *B66F 9/22* (2013.01)

(58) Field of Classification Search
CPC ..... F04B 2201/1202; F04B 2201/1203; F15B 2011/0246
See application file for complete search history.

(56) References Cited

U.S. PATENT DOCUMENTS 4,723,107 A * 2/1988 Schmid ..... F15B 21/14 318/139
5,505,043 A * 4/1996 Baginski ..... B66F 9/20 60/477

(Continued)

FOREIGN PATENT DOCUMENTS

GB 2360757 A * 10/2001 ..... B66F 9/22
JP 02163300 A * 6/1990 ..... F15B 11/00

(Continued)

OTHER PUBLICATIONS

International Preliminary Report on Patentability dated Sep. 1, 2015 from the European Patent Office in counterpart application International application No. PCT/JP2014/053128.

*Primary Examiner* — Michael Leslie
*Assistant Examiner* — Matthew Wiblin
(74) *Attorney, Agent, or Firm* — Sughrue Mion, PLLC

(57) ABSTRACT

A hydraulic control device for a forklift includes: a plurality of hydraulic mechanisms including a lifting/lowering hydraulic cylinder and a tilting hydraulic cylinder; a hydraulic pump; an electric motor; a discharge control mechanism; a proportional valve; a flow rate control valve; and a controller. When the lifting/lowering hydraulic cylinder performs a lowering operation of the fork and a hydraulic mechanism other than the lifting/lowering hydraulic cylinder simultaneously performs a further operation, the controller controls an open degree of the proportional valve in accordance with a rotation speed difference of a required lowering operation rotation speed for the hydraulic pump, which is required to perform the lowering operation at an (Continued)

instructed speed that is in accordance with an operation amount of the lifting/lowering control member, and a required further operation rotation speed for the hydraulic pump, which is required to perform the further operation.

4 Claims, 6 Drawing Sheets

(56) References Cited

U.S. PATENT DOCUMENTS

| | | | | |
|---|---|---|---|---|
| 5,649,422 | A | 7/1997 | Baginski et al. | |
| 2010/0021313 | A1* | 1/2010 | Devan | F04B 17/03 417/44.1 |
| 2013/0199170 | A1* | 8/2013 | Neumann | B66F 9/22 60/384 |
| 2015/0013324 | A1* | 1/2015 | Matsuo | B66F 9/22 60/459 |

FOREIGN PATENT DOCUMENTS

| | | | |
|---|---|---|---|
| JP | 2-231398 | A | 9/1990 |
| JP | 2007-254058 | A | 10/2007 |
| JP | 2012-232815 | A | 11/2012 |
| JP | 2013-133196 | A | 7/2013 |

* cited by examiner

HYDRAULIC CONTROL DEVICE FOR FORKLIFT

CROSS REFERENCE TO RELATED APPLICATIONS

This application is a National Stage of International Application No. PCT/JP2014/053128 filed Feb. 12, 2014, claiming priority based on Japanese Patent Application No. 2013-037069 filed Feb. 27, 2013, the contents of all of which are incorporated herein by reference in their entirety.

TECHNICAL FIELD

The present invention relates to a hydraulic control device for a forklift.

BACKGROUND ART

A conventional forklift uses a hydraulic cylinder as a mechanism that operates a movable member such as a fork or a mast. Patent Document 1 discloses an example of a hydraulic device including a single hydraulic pump and a single electric motor, which drives the hydraulic pump. The hydraulic pump generates rotation to operate a hydraulic cylinder (lift cylinder) that lifts and lowers a fork and a hydraulic cylinder (tilt cylinder) that tilts a mast.

PRIOR ART DOCUMENT

Patent Document

Patent Document 1: Japanese Laid-Open Patent Publication No. 2-231398

SUMMARY OF THE INVENTION

Problems that are to be Solved by the Invention

When a hydraulic device having a single hydraulic pump solely lifts and lowers a fork and solely tilts a mast, the hydraulic device controls and drives an electric motor in accordance with the speed at which an operation subject is instructed to operate. This allows the operation subject to be operated at the instructed speed. However, when the hydraulic device simultaneously operates a plurality of operation subjects such as a fork and a mast, the electric motor is driven and controlled in accordance with the speed instructed for the operation of only one of the operation subjects. Thus, it is difficult to operate the two operation subjects at their instructed speeds.

It is an object of the present invention to provide a hydraulic control device for a forklift that is capable of operating a plurality of operation subjects in a favorable manner.

Means for Solving the Problem

To achieve the above object, a hydraulic control device for a forklift according to one embodiment of the present invention includes a plurality of hydraulic mechanisms, a hydraulic pump, an electric motor, a discharge control mechanism, a proportional valve, a flow rate control valve, and a controller. The hydraulic mechanisms include a lifting/lowering hydraulic cylinder and a tilting hydraulic cylinder. The lifting/lowering hydraulic cylinder lifts and lowers a fork by supplying and discharging hydraulic oil in accordance with an operation of a lifting/lowering instruction member. The tilting hydraulic cylinder tilts a mast, on which the fork is mounted, by supplying and discharging hydraulic oil in accordance with an operation of a tilting instruction member. The electric motor drives the hydraulic pump. The discharge control mechanism is arranged between the lifting/lowering hydraulic cylinder and the hydraulic pump. The discharge control mechanism allows hydraulic oil to be discharged from the lifting/lowering hydraulic cylinder to the hydraulic pump when lowering the fork and stops the discharge of hydraulic oil from the lifting/lowering hydraulic cylinder to the hydraulic pump when stopping or lifting the fork. The proportional valve is arranged between the discharge control mechanism and a drain. The flow rate control valve is arranged between the discharge control mechanism and the drain. The flow rate control valve opens at an open degree that is in accordance with a pressure difference between a front side and a rear side of the proportional valve. The controller controls and drives the motor. When the lifting/lowering hydraulic cylinder performs a lowering operation of the fork and a hydraulic mechanism other than the lifting/lowering hydraulic cylinder simultaneously performs a further operation, the controller controls an open degree of the proportional valve in accordance with a rotation speed difference of a required lowering operation rotation speed for the hydraulic pump, which is required to perform the lowering operation at an instructed speed that is in accordance with an operation amount of the lifting/lowering control member, and a required further operation rotation speed for the hydraulic pump, which is required to perform the further operation.

EMBODIMENTS OF THE INVENTION

One embodiment of a hydraulic control device for a forklift will now be described with reference to FIGS. 1 to 5.

Figure 1:
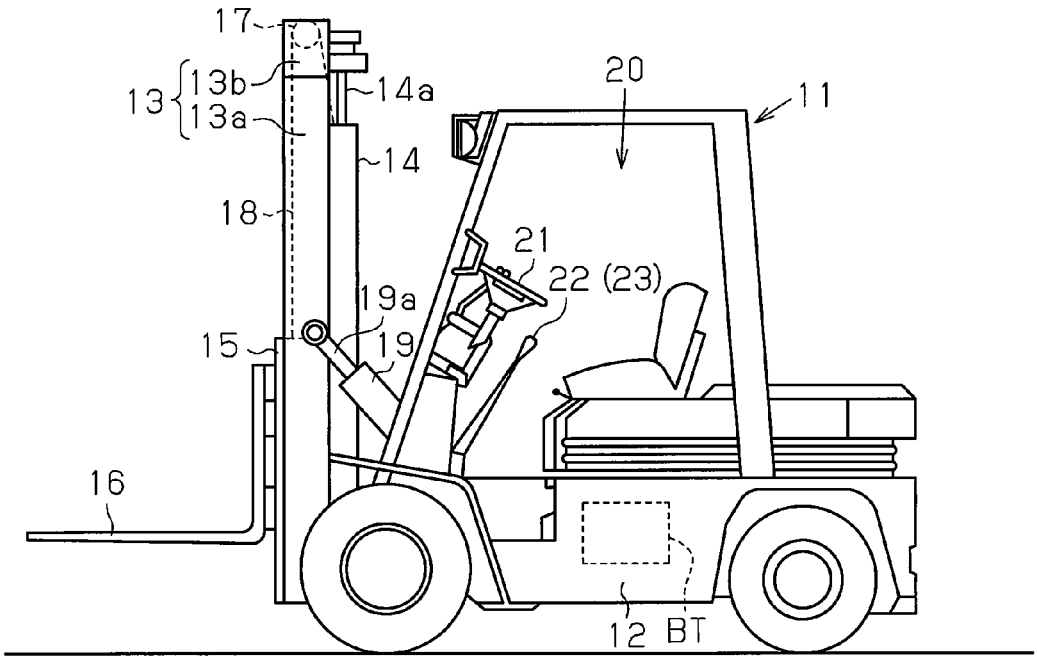
FIG. 1 is a side view showing a forklift according to one embodiment of the present invention.

As shown in FIG. 1, a battery forklift 11 includes a vehicle frame 12 and a mast 13, which is arranged at the front of the vehicle frame 12. The mast 13 includes two outer masts 13*a* and an inner mast 13*b*. The two outer masts 13*a* are arranged at the left and right sides and supported to be tiltable relative to the vehicle frame 12. The inner mast 13*b* is arranged at the inner side of the outer masts 13*a* in a manner enabling lifting and lowering of the inner mast 13*b*. A lift cylinder 14, which serves as a hydraulic mechanism and a lifting/lowering hydraulic cylinder, is fixed in parallel to the rear sides of the two outer masts 13*a*. The lift cylinder 14 includes a piston rod 14*a*. A distal end of the piston rod 14*a* is coupled to the upper portion of the inner mast 13*b*.

A lift bracket 15 is arranged at the inner side of the inner mast 13*b* in a manner enabling lifting and lowering of the lift bracket 15 along the inner mast 13*b*. A fork 16 is mounted on the lift bracket 15. The upper portion of the inner mast 13*b* supports a chain wheel 17. A chain 18 runs around the chain wheel 17. The chain 18 includes a first end, which is coupled to the upper portion of the lift cylinder 14, and a second end, which is coupled to the lift bracket 15. The extension and retraction of the lift cylinder 14 lifts and lowers the fork 16 and the lift bracket 15 with the chain 18.

Tilt cylinders 19, which serve as a hydraulic mechanism and a tilt hydraulic cylinder, each include a piston rod 19*a*. Basal ends of the tilt cylinders 19 are pivotally supported by the left and right sides of the vehicle frame 12. Distal ends of the piston rods 19*a* are pivotally coupled to substantially middle portions of the outer masts 13*a* in the vertical direction. Extension and retraction of the tilt cylinder 19 tilts the mast 13.

The front of a cabin 20 includes a steering wheel 21, a lift operating lever 22, which serves as a lifting/lowering instruction member, and a tilt operating lever 23, which serves as a tilting instruction member. In FIG. 1, the operating levers 22 and 23 are illustrated overlapping each other. The lift operating lever 22 is operated to extend and retract the lift cylinder 14 and lift and lower the fork 16. The tilt operating lever 23 is operated to extend and retract the tilt cylinder 19 and tilt the mast 13.

The mast 13 may be tilted between the rearmost tilted position and the frontmost tilted position, which are set in advance. When the position of the mast 13 shown in FIG. 1 is referred to as a vertical position, an operation for tilting the mast 13 toward the cabin 20 is referred to as a rearward tilting operation and an operation for tilting the mast 13 away from the cabin 20 is referred to as a frontward tilting operation. The forklift 11 of the present embodiment is configured to tilt the mast 13 toward the front when the mast 13 is moved in a direction the tilt cylinder 19 extends and to tilt the mast 13 toward the rear when the mast 13 is moved in a direction the tilt cylinder 19 retracts.

When the forklift 11 includes a hydraulic attachment, the forklift 11 is provided with a hydraulic mechanism that operates the attachment. The hydraulic mechanism is, for example, a hydraulic cylinder. The attachment is, for example, an attachment that moves the fork 16 to the left and right, tilts the fork 16, or rotates the fork 16. The cabin 20 includes an attachment operating lever, which instructs the operation of the attachment.

The hydraulic control device of the present embodiment will now be described with reference to FIG. 2.

The hydraulic control device of the present embodiment controls the operations of the lift cylinder 14, the tilt cylinder 19, and an attachment hydraulic cylinder 25. The hydraulic control device forms a hydraulic circuit, which includes a single pump and a single electric motor that drives the pump. The hydraulic circuit operates each hydraulic cylinder.

A pipe K1, which is connected to a bottom chamber 14*b* of the lift cylinder 14, is connected to a hydraulic pump motor 30, which functions as a hydraulic pump and a hydraulic motor. A motor 31 (rotating electrical machine), which functions as an electric motor and an electric generator, is connected to the hydraulic pump motor 30. In the present embodiment, the motor 31 functions as an electric motor when the hydraulic pump motor 30 is operated as a hydraulic pump, and the motor 31 functions as an electric generator when the hydraulic pump motor 30 is operated as a hydraulic motor. The hydraulic pump motor 30 of the present embodiment is capable of generating rotation in a single direction.

A lowering switch valve 32, which serves as an on/off valve, is arranged between the lift cylinder 14 and the hydraulic pump motor 30. The lowering switch valve 32 may be set at two positions, namely, a first position 32*a* when open and a second position 32*b* when closed. The lowering switch valve 32 of the present embodiment includes a discharge control mechanism. When the lowering switch valve 32 is set at the first position 32*a*, the discharge control mechanism allows hydraulic oil to be discharged from the bottom chamber 14*b* of the lift cylinder 14 to the hydraulic pump motor 30. When the lowering switch valve 32 is set at the second position 32*b*, the discharge control mechanism restricts the discharge of hydraulic oil from the bottom chamber 14*b* to the hydraulic pump motor 30. The hydraulic pump motor 30 includes a suction port 30*a*. An oil tank 34, which stores hydraulic oil, is connected to the suction port 30*a* through a check valve 33. The check valve 33 allows hydraulic oil to flow from the oil tank 34 and restricts the flow of hydraulic oil in the opposite direction.

A pipe K2, which is branched from the pipe K1 and serves as a drain connected to the oil tank 34, is connected to a hydraulic oil discharge side of the lowering switch valve 32. A flow rate control valve 35 and a lowering proportional valve 36, which serves as a proportional valve, are sequentially arranged in the pipe K2 from the portion branched from the pipe K1 toward the oil tank 34.

The flow rate control valve 35 may be set at a first position 35*a*, at which the flow rate control valve 35 opens, a second position 35*b*, at which the flow rate control valve 35 closes, or a third position 35*c*, at which the flow rate control valve 35 opens in a manner allowing for adjustment of its open degree. The flow rate control valve 35 of the present embodiment opens at an open degree that is in accordance with the pressure difference between the front and rear sides of the lowering proportional valve 36. More specifically, the flow rate control valve 35 is operated in accordance with the pressure difference so that the flow rate control valve 35 may be set at one of the first position 35*a*, the second position 35*b*, and the third position 35*c*. The lowering proportional valve 36 may be set at a first position 36*a*, at which the lowering proportional valve 36 opens at any open degree that may be changed, or a second position 36*b*, at which the lowering proportional valve 36 closes and does not allow the flow of hydraulic oil. In the hydraulic control device of the present embodiment, the flow rate control valve 35 and the lowering proportional valve 36 are used to control the flow rate of the hydraulic oil that flows through the pipe K2, which serves as a drain. The hydraulic oil that flows through the pipe K2 returns to the oil tank 34.

The flow rate control valve 35 is operated so that the open degree decreases as the pressure difference between the front and rear sides of the lowering proportional valve 36 increases and the open degree increases as the pressure difference decreases. The pressure difference between the front and rear sides of the lowering proportional valve 36 decreases as the open degree of the lowering proportional valve 36 increases. When the flow rate control valve 35 is set at the second position 35*b* and closed, the hydraulic oil discharged from the bottom chamber 14*b* of the lift cylinder 14 flows to the suction port 30*a* of the hydraulic pump motor 30 at flow rate Q1, which is shown in FIG. 2. When the flow rate control valve 35 is set at the first position 35*a* or the third position 35*c* and open, the hydraulic oil discharged from the bottom chamber 14*b* of the lift cylinder 14 flows to the suction port 30*a* of the hydraulic pump motor 30 and to the oil tank 34. That is, hydraulic oil flows to the suction port 30*a* of the hydraulic pump motor 30 at flow rate Q1 shown in FIG. 2, and hydraulic oil flows to the oil tank 34 at flow rate Q2 shown in FIG. 2. The flow rate control valve 35 is adjusted in advance so that the flow rate control valve 35 may have a desired open degree in accordance with the pressure difference between the front and rear sides of the lowering proportional valve 36.

A lifting proportional valve 37 and a check valve 38 are connected to the pipe K1 at a portion that extends from a discharge port 30*b* of the hydraulic pump motor 30. The lifting proportional valve 37 may be set at a first position 37*a*, at which the lifting proportional valve 37 opens at any open degree that may be changed, and at a second position 37*b*, at which the lifting proportional valve 37 closes. The first position 37*a* allows the hydraulic oil discharged from the hydraulic pump motor 30 to flow to the bottom chamber 14*b*. The second position 37*b* allows the hydraulic oil to flow to a tilting proportional valve 39, which is connected to a pipe K3. The check valve 38 is connected to the lift cylinder 14 and the lifting proportional valve 37 to allow hydraulic oil from the lifting proportional valve 37 to flow to the bottom chamber 14*b* of the lift cylinder 14 and to restrict the flow of hydraulic oil in the opposite direction.

A pipe K4, which is connected to the oil tank 34 through a filter 40, and a pipe K5, which is connected to the tilting proportional valve 39, are connected to the pipe K1 at a portion that extends from the discharge port 30*b* of the hydraulic pump motor 30. A relief valve 41, which restricts increases in the hydraulic pressure, is connected to the pipe K4. A pipe K6, through which hydraulic oil flows from the tilting proportional valve 39 to the oil tank 34, is connected to the pipe K4. A check valve 42, which allows hydraulic oil to flow from the hydraulic pump motor 30 and restricts the flow of hydraulic oil in the opposite direction, is connected to the pipe K5.

The tilting proportional valve 39 may be set at a first position 39*a*, at which the tilting proportional valve 39 closes, a second position 39*b*, at which the tilting proportional valve 39 opens in a manner allowing for adjustment of its open degree, or a third position 39*c*, at which the tilting proportional valve 39 opens in a manner allowing for adjustment of its open degree. The first position 39*a* allows hydraulic oil to flow from the lifting proportional valve 37 to the oil tank 34 through the pipe K3. The tilting proportional valve 39 of the present embodiment moves toward the second position 39*b* or the third position 39*c* with the first position 39*a* serving as a neutral position under the control of a controller S. The second position 39*b* allows hydraulic oil to flow from the check valve 42 to a pipe K7, which is connected to a rod chamber 19*r* of the tilt cylinder 19. Further, the second position 39*b* allows the hydraulic oil from a pipe K8, which is connected to the bottom chamber 19*b* of the tilt cylinder 19, to flow to the pipe K6. The third position 39*c* allows the hydraulic oil from the check valve 42 to flow to the pipe K8 and allows the hydraulic oil from the pipe K7 to flow to the pipe K6.

An attachment proportional valve 43 is connected to the pipe K3 at a portion between the tilting proportional valve 39 and the oil tank 34. A pipe K9, through which hydraulic oil flows from the attachment proportional valve 43 to the oil tank 34, is connected to the pipe K4. The pipe K5 is connected to the attachment proportional valve 43. A check valve 44, which allows hydraulic oil to flow from the hydraulic pump motor 30 and restricts the flow of hydraulic oil in the opposite direction, is connected to the pipe K5.

The attachment proportional valve 43 may be set at a first position 43*a*, at which the attachment proportional valve 43 closes, a second position 43*b*, at which the attachment proportional valve 43 opens in a manner allowing for adjustment of its open degree, or a third position 43*c*, at which the attachment proportional valve 43 opens in a manner allowing for adjustment of its open degree. The first position 43*a* allows the hydraulic oil from the tilting proportional valve 39 to flow to the oil tank 34 through the pipe K3. The attachment proportional valve 43 of the present embodiment moves toward the second position 43*b* or the third position 43*c* with the first position 43*a* serving as a neutral position under the control of the controller S. The second position 43*b* allows the hydraulic oil from the check valve 44 to flow to a pipe K10, which is connected to a rod chamber 25*r* of the hydraulic cylinder 25. Further, the second position 43*b* allows the hydraulic oil from a pipe K11, which is connected to a bottom chamber 25*b* of the attachment hydraulic cylinder 25, to flow to the pipe K9. The third position 43*c* allows the hydraulic oil from the check valve 44 to flow to the pipe K11 and allows the hydraulic oil from the pipe K10 to flow to the pipe K9.

The configuration of the controller S of the hydraulic control device will now be described.

A potentiometer 22*a*, a potentiometer 23*a*, and a potentiometer 45*a* are electrically connected to the controller S. The potentiometer 22*a* detects the operation amount of the lift operating lever 22, the potentiometer 23*a* detects the operation amount of the tilt operating lever 23, and the potentiometer 45*a* detects the operation amount of an attachment operating lever 45. The controller S controls the rotation of the motor 31, the switching of the lowering switch valve 32, the switching of the lowering proportional valve 36, and the switching of the lifting proportional valve 37 in response to the detection signal from the potentiometer 22*a* based on the operation amount of the lift operating lever 22. The controller S controls the rotation of the motor 31 and the switching of the tilting proportional valve 39 in response to the detection signal from the potentiometer 23*a* based on the operation amount of the tilt operating lever 23. The controller S controls the rotation of the motor 31 and the switching of the attachment proportional valve 43 in response to the detection signal from the potentiometer 45*a* based on the operation amount of the attachment operating lever 45.

An inverter S1 is electrically connected to the controller S. The power from a battery BT is supplied to the motor 31 through the inverter S1. The power generated by the motor 31 is stored in the battery BT through the inverter S1.

The operation of the hydraulic control device in the present embodiment will now be described.

Figure 3:
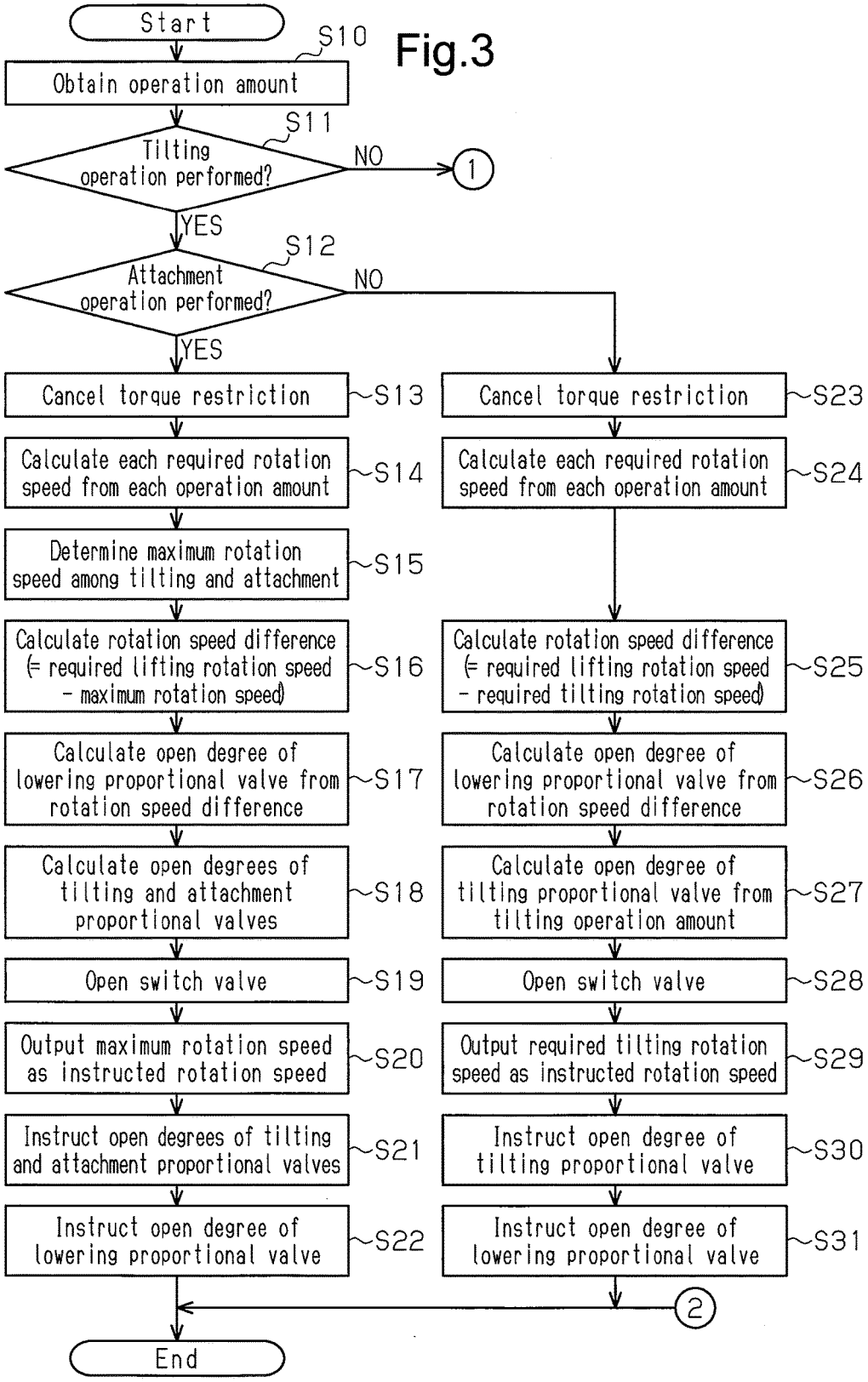
FIG. 3 is a flowchart showing the contents of the control executed when a plurality of operation subjects in FIG. 1 are operated.

First, the contents of the control executed when the lowering operation of the fork 16 is solely performed and the contents of the control executed when the lowering operation of the fork 16 is performed simultaneously with a further operation of the mast 13 or the attachment will be described with reference to FIGS. 3 and 4.

When the lift operating lever 22 is operated to instruct a lowering operation, the controller S obtains the operation amount of each of the operating levers 22, 23, and 45 (step S10). Subsequently, the controller S determines whether or not the tilt operating lever 23 has been operated based on the operation amount obtained in step S10 (step S11). When the determination result is affirmative, the controller S determines whether or not the attachment operating lever 45 has been operated based on the operation amount obtained in step S10 (step S12). When the determination result is affirmative, the lowering operation of the fork 16, the frontward or rearward tilting operation of the mast 13, and the operation of the attachment have been performed simultaneously. Thus, the controller S performs the processes from step S13.

In step S13, the controller S cancels a torque restriction that restricts the output torque of the motor 31. When the torque restriction is cancelled, the controller S performs a power running operation with the motor 31. Then, from the operation amounts obtained in step S10, the controller S calculates the required rotation speed of the hydraulic pump motor 30 that is required to perform an operation at the speed instructed by each operation amount (step S14). More specifically, in step S14, the controller S calculates a required lifting rotation speed, which serves as a required lowering operation rotation speed and which is required to lower the fork 16 at the instructed speed. Further, the controller S calculates a required tilting rotation speed, which is required to tilt the mast 13 toward the front or the rear at the instructed speed, and a required attachment rotation speed, which is required to operate the attachment at the instructed speed. The required tilting rotation speed and the required attachment rotation speed each serves as a required further operation rotation speed.

Then, among the required rotation speeds calculated in step S14, the controller S compares the required tilting rotation speed and the required attachment rotation speed to determine the maximum rotation speed (step S15). Subsequently, the controller S calculates a rotation speed difference of the required lifting rotation speed calculated in step S14 and the maximum rotation speed determined in step S15 (step S16). Then, the controller S calculates the open degree of the lowering proportional valve 36 from the rotation speed difference calculated in step S16 (step S17). More specifically, in step S17, the controller S calculates the open degree of the lowering proportional valve 36 based on information that is stored in advance and indicates the relationship of the rotation speed difference and the open degree of the lowering proportional valve 36.

Figure 5:
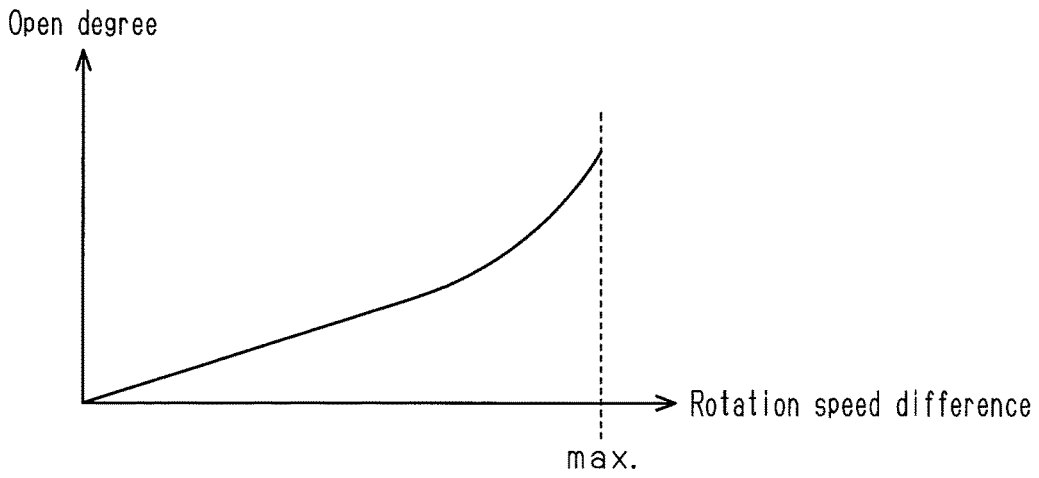
FIG. 5 is a diagram showing the relationship of a rotation speed difference between operation subjects and an open degree of a lowering proportional valve.

As shown in FIG. 5, the information that indicates the relationship of the rotation speed difference and the open degree of the lowering proportional valve 36 is mapped and stored. The information is constructed so that the open degree of the lowering proportional valve 36 increases as the rotation speed difference increases. The rotation speed difference increases as the compared rotation speed, which is compared with the required lifting rotation speed, decreases. In step S16, for example, the compared rotation speed is the maximum rotation speed. In the hydraulic control device of the present embodiment, when the compared rotation speed is less than the required lifting rotation speed, the hydraulic oil discharged from the lift cylinder 14 flows from the pipe K2 to the oil tank 34 to conform to the instructed speed of the lowering operation. Thus, in the information shown in FIG. 5, the open degree of the lowering proportional valve 36 and the flow rate of the hydraulic oil flowing to the pipe K2 increase as the rotation speed difference increases.

Then, the controller S calculates the valve open degree of the tilting proportional valve 39 based on the operation amount of the tilt operating lever 23 obtained in step S10. Further, the controller S calculates the valve open degree of the attachment proportional valve 43 based on the operation amount of the attachment operating lever 45 obtained in step S10 (step S18). The controller S then opens the lowering switch valve 32 at the first position 32*a* (step S19). The controller S outputs the maximum rotation speed, which is determined in step S15, as an instructed rotation speed of the motor 31 (step S20). The controller S instructs the valve open degree for the tilting proportional valve 39 calculated in step S18 and opens the tilting proportional valve 39 at the second position 39*b* or the third position 39*c* to perform the operation instructed by the tilt operating lever 23 (step S21). In step S21, the controller S instructs the valve open degree for the attachment proportional valve 43 calculated in step S18 and opens the attachment proportional valve 43 at the second position 43*b* or the third position 43*c* to perform the operation instructed by the attachment operating lever 45. The controller S instructs the valve open degree for the lowering proportional valve 36 calculated in step S17 to open the lowering proportional valve 36 (step S22).

When the determination result of step S12 is negative, the lowering operation of the fork 16 and the frontward or rearward tilting operation of the mast 13 are simultaneously performed. Thus, the controller S performs the processes from step S23.

In step S23, the controller S cancels the torque restriction in a manner similar to step S13. Then, from the operation amounts obtained in step S10, the controller S calculates the required lifting rotation speed, which is required to lower the fork 16 at the instructed speed, and the required tilting rotation speed, which is required to tilt the mast 13 toward the front or the rear at the instructed speed (step S24). Subsequently, the controller S calculates a rotation speed difference of the required lifting rotation speed and the required tilting rotation speed, which have been calculated in step S24 (step S25). Further, the controller S calculates the open degree of the lowering proportional valve 36 from the rotation speed difference calculated in step S25 (step S26). More specifically, in step S26, the controller S calculates the open degree of the lowering proportional valve 36 based on the information shown in FIG. 5 in a manner similar to step S17.

Then, the controller S calculates the valve open degree of the tilting proportional valve 39 based on the operation amount of the tilt operating lever 23 obtained in step S10 (step S27). The controller S opens the lowering switch valve 32 at the first position 32*a* (step S28). Further, the controller S outputs the required tilting rotation speed calculated in step S24 as an instructed rotation speed of the motor 31 (step S29). The controller S instructs the valve open degree for the tilting proportional valve 39 calculated in step S27 and opens the tilting proportional valve 39 at the second position 39*b* or the third position 39*c* to perform the operation instructed by the tilt operating lever 23 (step S30). Further, the controller S instructs the valve open degree for the lowering proportional valve 36 calculated in step S26 and opens the lowering proportional valve 36 (step S31).

Figure 4:
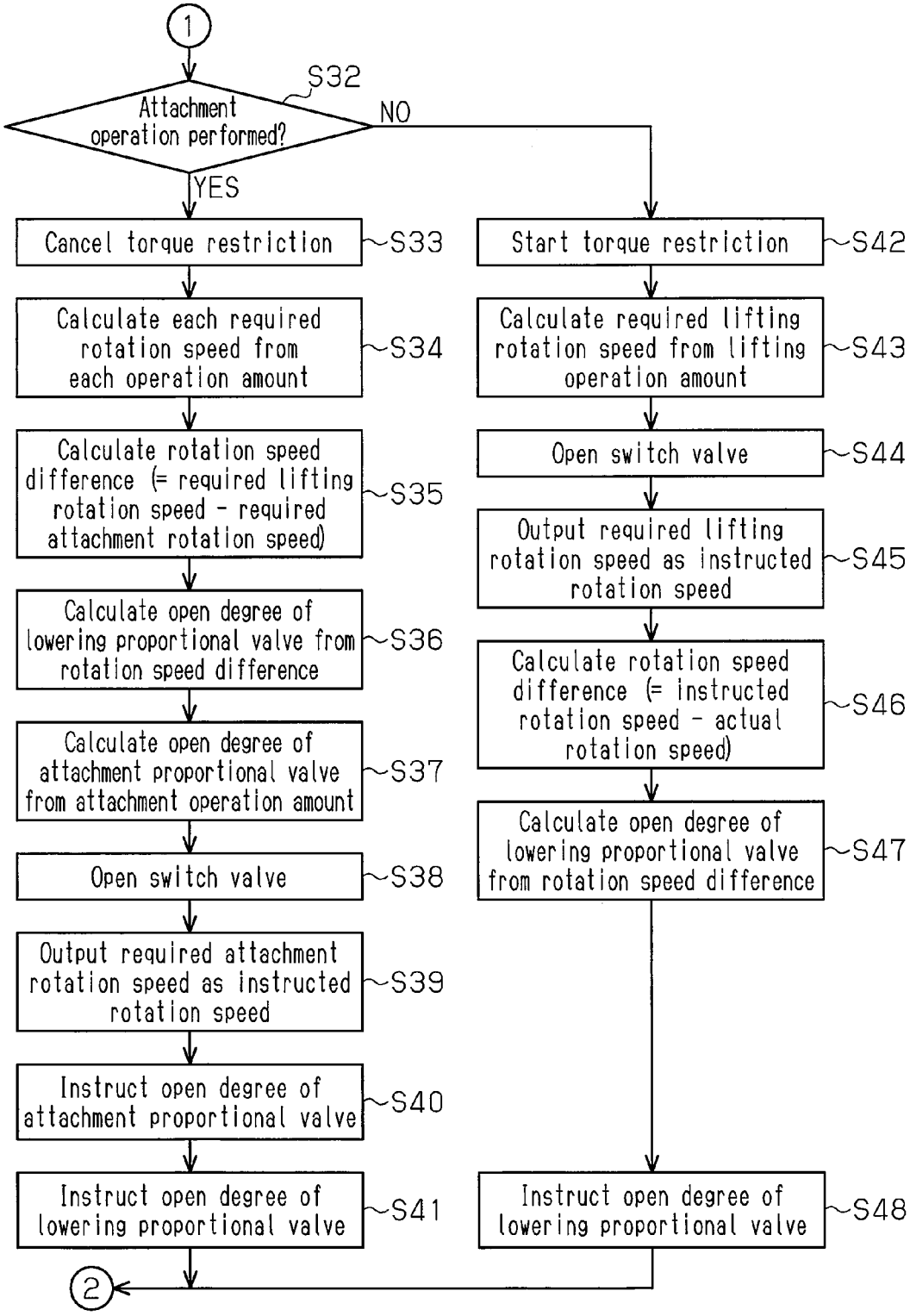
FIG. 4 is a flowchart showing the contents of the control executed in the same manner as FIG. 3.

When the determination result of step S11 is negative, the controller S proceeds to step S32 shown in FIG. 4 to determine whether or not the attachment operating lever 45 has been operated based on the operation amount obtained in step S10. When the determination result is affirmative, the lowering operation of the fork 16 and the operation of the attachment have been performed simultaneously. Thus, the controller S performs the processes from step S33.

In step S33, the controller S cancels the torque restriction in a manner similar to steps S13 and S23. Then, from the operation amounts obtained in step S10, the controller S calculates the required lifting rotation speed, which is required to lower the fork 16 at the instructed speed, and the required attachment rotation speed, which is required to operate the attachment at the instructed speed (step S34). Subsequently, the controller S calculates a rotation speed difference of the required lifting rotation speed and the required attachment rotation speed, which have been calculated in step S34 (step S35). The controller S calculates the open degree of the lowering proportional valve 36 from the rotation speed difference, which has been calculated in step S35. More specifically, in step S36, the controller S calculates the open degree of the lowering proportional valve 36 based on the information shown in FIG. 5 in a manner similar to steps S17 and S26.

Then, the controller S calculates the valve open degree of the attachment proportional valve 43 based on the operation amount of the attachment operating lever 45 obtained in step S10 (step S37). The controller S opens the lowering switch valve 32 at the first position 32*a* (step S38). The controller S outputs the required attachment rotation speed calculated in step S34 as an instructed rotation speed for the motor 31 (step S39). Further, the controller S instructs the valve open degree for the attachment proportional valve 43 calculated in step S37 and opens the attachment proportional valve 43 at the second position 43*b* or the third position 43*c* to perform the operation instructed by the attachment operating lever 45 (step S40). The controller S instructs the valve open degree for the lowering proportional valve 36 calculated in step S36 and opens the lowering proportional valve 36 (step S41).

The lowering operation of the fork 16 and a further operation may be performed simultaneously when the required rotation speed of the further operation is lower than the required rotation speed of the lowering operation thereby producing a rotation speed difference. In such a case, when all of the hydraulic oil discharged from the lift cylinder 14 flows to the hydraulic pump motor 30, the further operation would not be able to conform to the instructed speed. More specifically, when all of the hydraulic oil discharged from the lift cylinder 14 is supplied to the hydraulic cylinder for the further operation to conform to the instructed speed of the lowering operation, the hydraulic cylinder for the further operation would be operated at a higher speed than the instructed speed. Additionally, the lowering operation of the fork 16 and a further operation may be performed simultaneously thereby producing a rotation speed difference. In such a case, when the hydraulic pump motor 30 is controlled at the required rotation speed of the further operation, the flow rate of the hydraulic oil discharged from the lift cylinder 14 would be insufficient and the lowering operation would not be able to conform to the instructed speed.

Thus, the hydraulic control device of the present embodiment controls the valve open degree of the lowering proportional valve 36 based on the rotation speed difference of the required rotation speed for the lowering operation and the required rotation speed for the further operation. Accordingly, the hydraulic oil discharged from the lift cylinder 14 flows from the pipe K2 to the oil tank 34 to conform to the instructed speed for the lowering operation. Under such a control, the flow rate control valve 35 controls the valve open degree of the lowering proportional valve 36 based on the calculation results of steps S17, S26, and S36. The open degree of the lowering proportional valve 36 is set in accordance with the pressure difference between the front and rear sides of the lowering proportional valve 36. When the flow rate control valve 35 opens, the hydraulic oil discharged from the lift cylinder 14 during the lowering operation flows to the hydraulic pump motor 30 and the oil tank 34 in accordance with the valve open degrees of the flow rate control valve 35 and the lowering proportional valve 36. Thus, even if the rotation speed of the hydraulic pump motor 30 is lower than the required rotation speed for the lowering operation, the hydraulic oil of which the flow rate is insufficient for conformance with the instructed speed flows through the pipe K2 to the oil tank 34 so that the lowering operation of the fork 16 conforms to the instructed speed. Further, the hydraulic oil discharged from the hydraulic pump motor 30 drives the hydraulic cylinder and controls the further operation simultaneously with the lowering operation of the fork 16.

When there is no rotation speed difference between the required rotation speed for the lowering operation and the required rotation speed for the further operation, the lowering proportional valve 36 is set at the second position 36*b* so that the flow rate control valve 35 does not open. Further, all of the hydraulic oil discharged from the lift cylinder 14 flows to the hydraulic pump motor 30. Thus, the lowering operation of the fork 16 conforms to the instructed speed. The further operation performed simultaneously with the lowering operation of the fork 16 is controlled by driving the hydraulic cylinder with the hydraulic oil discharged from the hydraulic pump motor 30.

Returning to the description of FIG. 4, when the determination result of step S32 is negative, the lowering operation of the fork 16 is solely performed. Thus, the controller S performs the processes from step S42. A solely performed operation means that when a single operation subject (e.g., fork 16) is operated, a further operation subject (e.g., mast 13 or attachment) is not operated.

In step S42, the controller S starts the torque restriction and sets an upper limit value (e.g., 0 Nm) for the output torque so that the motor 31 does not consume unnecessary power. That is, the controller S starts the torque restriction to restrict the power running operation of the motor 31.

The controller S calculates the required lifting rotation speed, which is required to lower the fork 16 at the instructed speed, from the operation amount obtained in step S10 (step S43). Then, the controller S opens the lowering switch valve 32 at the first position 32*a* (step S44). Further, the controller S outputs the required lifting rotation speed calculated in step S43 as an instructed rotation speed for the motor 31 (step S45).

The controller S calculates a rotation speed difference based on the instructed rotation speed output in step S45 and the actual rotation speed of the motor 31 (step S46). The controller S calculates the open degree of the lowering proportional valve 36 from the rotation speed difference calculated in step S46 (step S47). In step S47, the controller S calculates the open degree of the lowering proportional valve 36 based on the information of FIG. 5 in a manner similar to steps S17, S26, and S36. The controller S instructs the valve open degree for the lowering proportional valve 36 calculated in step S47 and opens the lowering proportional valve 36 (step S48).

When the lowering switch valve 32 opens, the hydraulic oil discharged from the bottom chamber 14*b* of the lift cylinder 14 flows to the hydraulic pump motor 30. When the motor 31 is operated at the instructed rotation speed using the drive force of the hydraulic oil discharged from the bottom chamber 14*b*, the output torque of the motor 31 has a negative value and a regenerative operation is performed. That is, the motor 31 functions as a generator since the hydraulic pump motor 30 functions as a hydraulic motor. Thus, the power generated by the motor 31 when operated as a generator is stored in the battery BT through the inverter S1.

Such a regenerative operation is performed if a lowering operation is performed when the load on the fork 16 is heavy enough. When the lowering operation is performed in such a case, the hydraulic oil is easily discharged from the bottom chamber 14*b* in accordance with the weight of the fork 16 and the load. Further, the hydraulic oil flows to the hydraulic pump motor 30 at the flow rate required to perform the lowering operation at the instructed speed in accordance with the operation amount of the lift operating lever 22. Thus, even when the motor 31 is not operated at the power running side, the hydraulic pump motor 30 is operated at the required instructed speed required to perform the lowering operation at the instructed speed that is in accordance with the operation amount of the lift operating lever 22, namely, the instructed rotation speed.

When the controller S is not able to control the speed of the lowering operation at the instructed speed like in the regenerative operation, the controller S opens the lowering proportional valve 36 and performs an operation for conformance with the instructed speed.

When the lowering operation is performed with a light load on the fork 16, the hydraulic oil may not be easily discharged from the bottom chamber 14*b* depending only on the weight of the fork 16 and load. The hydraulic oil does not easily flow to the hydraulic pump motor 30 at the flow rate required to perform the lowering operation at the instructed speed in accordance with the operation amount of the lift operating lever 22. Thus, the power running operation needs to be performed by the motor 31 so that the hydraulic pump motor 30 generates rotation at the instructed rotation speed for conformance with the instructed speed. However, the power running of the motor 31 consumes power. Thus, the hydraulic control device of the present embodiment performs torque restricting control to reduce power consumption. When the motor 31 is controlled during such torque restriction, the rotation speed of the motor 31 is reduced. Thus, although the flow rate required to perform the lowering operation at the instructed speed is insufficient, the flow rate control valve 35 and the lowering proportional valve 36 are operated to compensate for the insufficient flow rate.

More specifically, the lowering proportional valve 36 opens at the open degree that is in accordance with the rotation speed of the instructed rotation speed and the actual rotation speed. The flow rate control valve 35 opens at the open degree that is in accordance with the pressure difference between the front and rear sides of the lowering proportional valve 36. This divides the hydraulic oil discharged from the lift cylinder 14 into hydraulic oil flowing to the hydraulic pump motor 30 at a flow rate (flow rate Q1 shown in FIG. 2) and hydraulic oil flowing to the oil tank 34 (drain side) via the flow rate control valve 35 and the lowering proportional valve 36 at a flow rate (flow rate Q2 shown in FIG. 2). Thus, the lowering operation conforms to the instructed speed when the flow rate control valve 35 and the lowering proportional valve 36 open the pipe K2, which serves as a flow passage for hydraulic oil, to compensate for the insufficient flow rate. In the hydraulic control device of the present embodiment, if a regenerative operation cannot be performed when a lowering operation is solely performed, the lowering operation conforms to the instructed speed by controlling the motor 31 while the flow rate control valve 35 and the lowering proportional valve 36 act to reduce power consumption.

The controller S performs the control described below when solely lifting the fork 16, solely tilting the mast 13 toward the front or the rear, and solely operating the attachment.

When lifting the fork 16, the controller S calculates the required rotation speed of the hydraulic pump motor 30, which is required to perform the lifting operation at the instructed speed in accordance with the operation amount of the lift operating lever 22, and a valve open degree of the lifting proportional valve 37. The controller S uses the calculated required rotation speed as an instructed rotation speed of the motor 31 to control and drive the motor 31 and to open the lifting proportional valve 37 at the first position 37*a* in accordance with the calculated valve open degree. Thus, the hydraulic pump motor 30 functions as a hydraulic pump, and the hydraulic oil discharged from the discharge port 30*b* is supplied to the bottom chamber 14*b* of the lift cylinder 14 through the lifting proportional valve 37 and the check valve 38.

When tilting the mast 13 toward the front or the rear, the controller S calculates the required rotation speed for the hydraulic pump motor 30, which is required to perform the frontward or rearward tilting operation in accordance with the operation amount of the tilt operating lever 23, and a valve open degree of the tilting proportional valve 39. The controller S uses the calculated required rotation speed as an instructed rotation speed of the motor 31 to control and drive the motor 31 and to open the tilting proportional valve 39 at the second position 39*b* or the third position 39*c* in accordance with the calculated valve open degree. The controller S sets the lowering switch valve 32 at the second position 32*b* and sets the lifting proportional valve 37 at the second position 37*b*.

Thus, the hydraulic pump motor 30 functions as a hydraulic pump, and the hydraulic oil discharged from the discharge port 30*b* is supplied through the check valve 42 and the tilting proportional valve 39 to the bottom chamber 19*b* when the frontward tilting operation is performed and supplied to the rod chamber 19*r* when the rearward tilting operation is performed. The hydraulic oil in the rod chamber 19*r* is discharged when the frontward tilting operation is performed, and the hydraulic oil in the bottom chamber 19*b* is discharged when the rearward tilting operation is performed.

When operating the attachment, the controller S calculates the required rotation speed for the hydraulic pump motor 30, which is required to operate the attachment in accordance with the operation amount of the attachment operating lever 45, and a valve open degree of the attachment proportional valve 43. The controller S uses the calculated required rotation speed as an instructed rotation speed of the motor 31 to control and drive the motor 31 and to open the attachment proportional valve 43 at the second position 43*b* or the third position 43*c* in accordance with the calculated valve open degree. The controller S sets the lowering switch valve 32 at the second position 32*b*, sets the lifting proportional valve 37 at the second position 37*b*, and sets the tilting proportional valve 39 at the first position 39*a*.

Thus, the hydraulic pump motor 30 functions as a hydraulic pump, and the hydraulic oil discharged from the discharge port 30*b* is supplied through the check valve 44 and the attachment proportional valve 43 to the bottom chamber 25*b* or to the rod chamber 25*r*. The hydraulic oil in the rod chamber 25*r* is discharged when the hydraulic oil is supplied to the bottom chamber 25*b*, and the hydraulic oil in the bottom chamber 25*b* is discharged when the hydraulic oil is supplied to the rod chamber 25*r*.

Accordingly, the present embodiment has the advantages described below.

(1) When a lowering operation of the fork 16 and a further operation are performed simultaneously and the required lifting rotation speed differs from the required rotation speed for the further operation, the hydraulic oil at the flow rate corresponding to the rotation speed difference flows to the pipe K2 (oil tank 34) through the flow rate control valve 35 and the lowering proportional valve 36. This allows a plurality of operation subjects to be operated in a favorable manner (e.g., lowering operation and further operation).

(2) When a lowering operation of the fork 16 and further operations are performed simultaneously, the rotation speed difference is calculated using the maximum rotation speed of the required rotation speeds of the further operations. This allows a plurality of operation subjects to be operated in a favorable manner.

(3) Even when the lowering operation of the fork 16 is solely performed, the instructed speed of the lowering operation is satisfied.

(4) The discharge control mechanism is formed by the lowering switch valve 32, which is an on/off valve. This reduces the leakage amount of hydraulic oil as compared to when using an electromagnetic proportional valve instead of the lowering switch valve 32. When a regenerative operation is performed, pressure loss is reduced and the regenerative operation is performed effectively.

(5) The flow rate control valve 35 and the lowering proportional valve 36 are arranged in the pipe K2 so that the flow rate control valve 35 functions as a pressure compensation valve. In this configuration, the flow rate of the hydraulic oil that flows to the oil tank 34 through the pipe K2 may be adjusted by the flow rate control valve 35. More specifically, when the open degree of the lowering proportional valve 36 is simply determined in accordance with the rotation speed difference, the flow rate of the hydraulic oil bypassed through the pipe K2 increases as weight of the load on the fork 16 increases. Thus, the speed of the lowering operation changes in accordance with the load even when the instructed speed is the same. In the present embodiment, the flow rate control valve 35 functions as a pressure compensation valve to reduce changes in the speed of the lowering operation speed caused by the load. This allows the forklift 11 to be stably operated.

The above embodiment may be modified as follows.

The member that instructs the lowering/lifting operation of the fork 16, the frontward or rearward tilting operation of the mast 13, and the operation of the attachment does not have to be of a lever type and may be of another structure. For example, the member may be of a button type.

The upper limit value of the output torque set in the torque restriction in step S42, which is shown in FIG. 4, may be greater than or equal to 0 Nm (e.g., 5 Nm).

The present embodiment may be applied to a hydraulic control device that controls the operation of the fork 16 and the operation of the mast 13 and does not include an attachment.

The present embodiment may also be applied to a hydraulic control device of a forklift 11 that includes a plurality of attachments.

The present invention may be embodied in a hydraulic control device of a forklift 11 including a hydraulic power steering mechanism that serves as a hydraulic mechanism. The flow rate of hydraulic oil required for the hydraulic power steering mechanism is determined in accordance with the steering speed. In general, the required flow rate is smaller than the flow rate of the hydraulic oil required for the lowering operation of the fork 16. Thus, when the lowering operation and the steering operation are performed simultaneously, power consumption may increase more than necessary, and the speed of the lowering operation may be insufficient. This problem may be solved by using the structure and control of the hydraulic control device of the present embodiment.

The layout of the flow rate control valve 35 and the lowering proportional valve 36 may be reversed. In this layout, the flow rate control valve 35 opens in accordance with the pressure difference between the front and rear sides of the lowering proportional valve 36. This configuration has the same advantages as the present embodiment.

Figure 2:
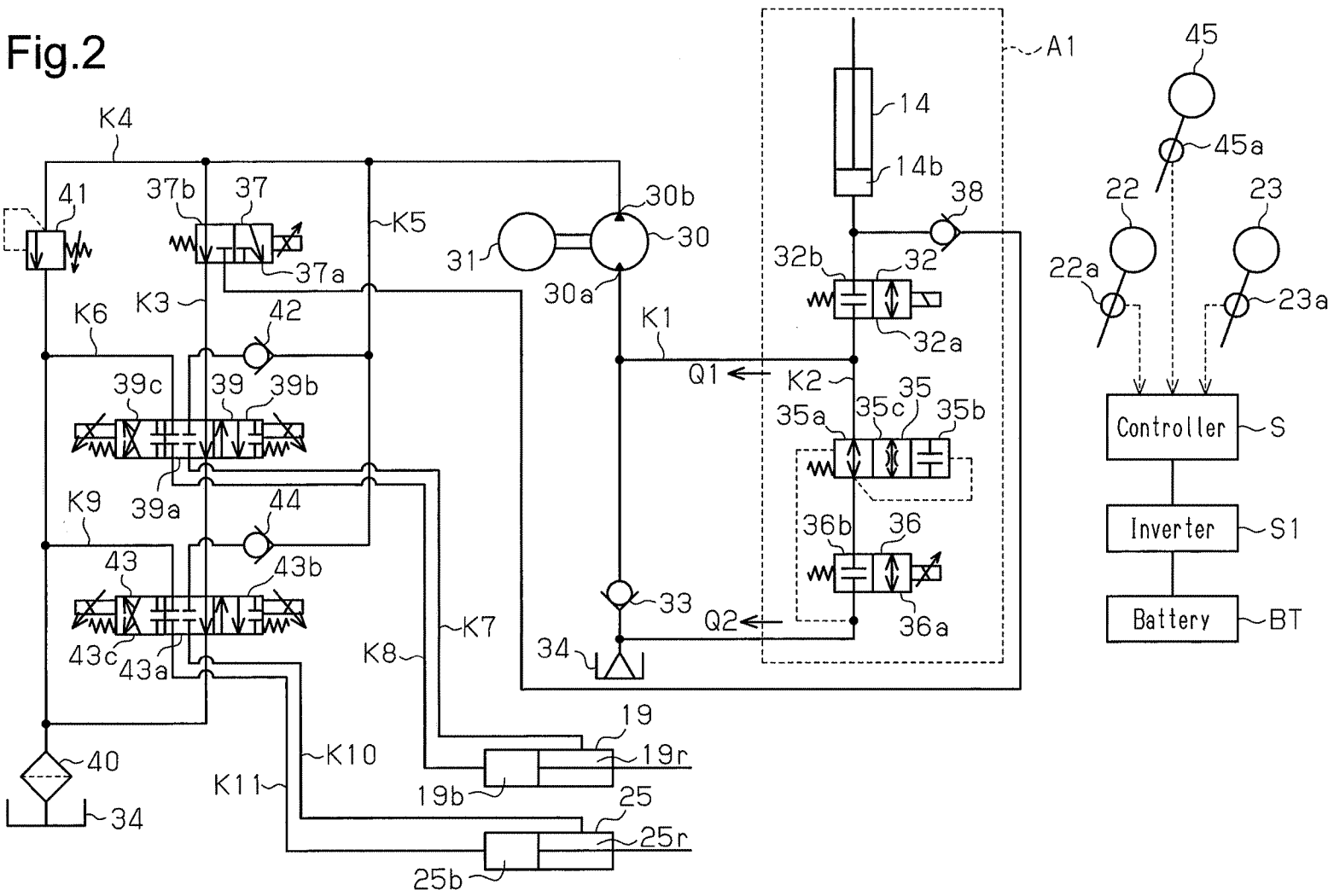
FIG. 2 is a circuit diagram of a hydraulic control device for the forklift shown in FIG. 1.
Figure 6:
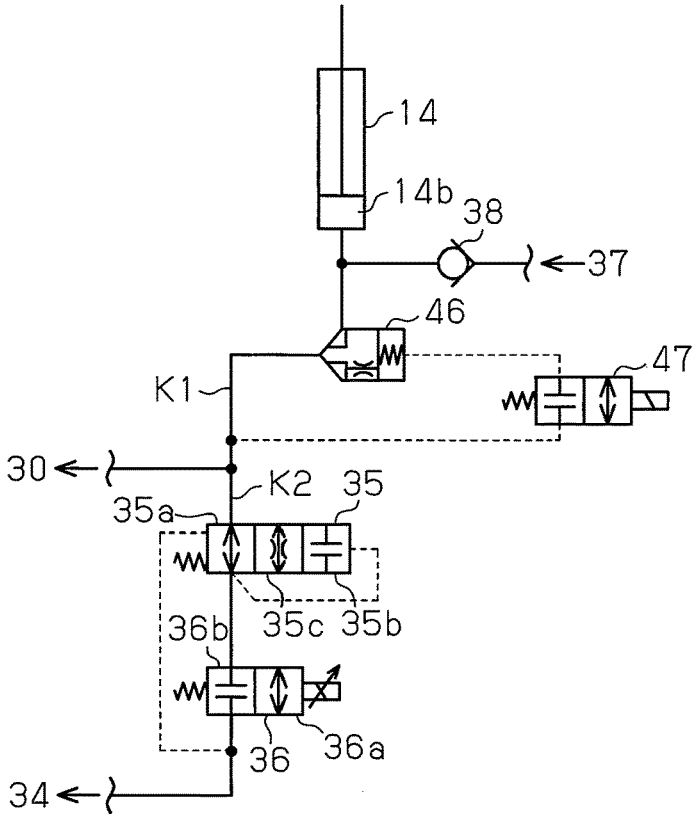
FIG. 6 is a circuit diagram showing a portion of a hydraulic control device in another example.

FIG. 6 corresponds to section Al, which is surrounded by broken lines in FIG. 2. As shown in FIG. 6, the discharge control mechanism may be formed by a poppet valve 46 and an electromagnetic valve 47 instead of the lowering switch valve 32. The electromagnetic valve 47 applies pilot pressure to the poppet valve 46. When the lowering operation is performed, the poppet valve 46 and the electromagnetic valve 47 open. This controls the flow rate of hydraulic oil flowing to the hydraulic pump motor 30 in accordance with the open degree of the poppet valve 46. Such a configuration allows hydraulic oil to be discharged when lowering the fork 16 and restricts the discharge of hydraulic oil when stopping or lifting the fork 16 in the same manner as the lowering switch valve 32 of the present embodiment. Further, this configuration has the same advantages as the present embodiment.

Figure 7:
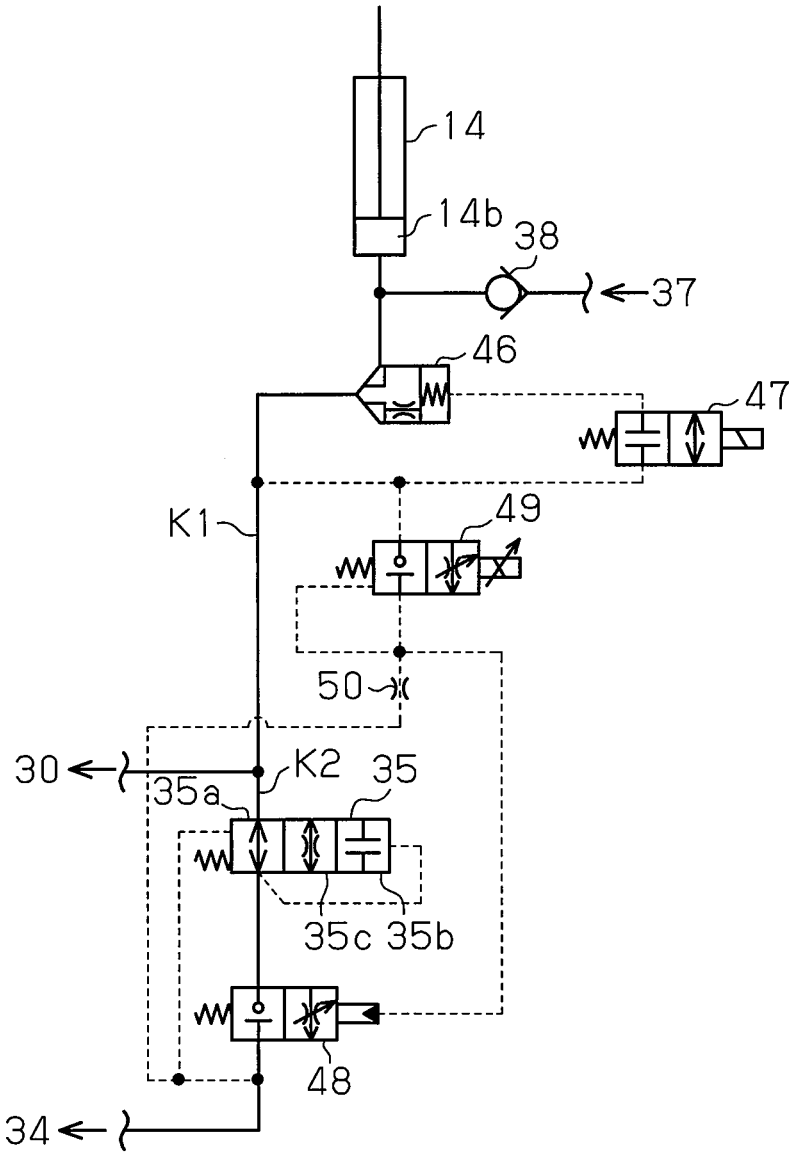
FIG. 7 is a circuit diagram showing a portion of a hydraulic control device in a further example.

FIG. 7 corresponds to section Al, which is surrounded by broken lines in FIG. 2. As shown in FIG. 7, the discharge control mechanism is formed by the poppet valve 46 and the electromagnetic valve 47 instead of the lowering switch valve 32. Further, a pilot proportional valve 48, which operates when receiving pilot pressure, is used instead of the lowering proportional valve 36. The pilot proportional valve 48 opens when receiving pilot pressure of an electromagnetic proportional valve 49, which is connected between the electromagnetic valve 47 and the pipe K1. The controller S controls the open degree of the electromagnetic proportional valve 49 in accordance with the rotation speed difference. This controls the open degree of the pilot proportional valve 48. In addition, an orifice 50 is connected to the flowing passage between the electromagnetic proportional valve 49 and the pilot proportional valve 48. Such a configuration allows hydraulic oil to be discharged when lowering the fork 16 and restricts the discharge of hydraulic oil when stopping or lifting the fork 16 in the same manner as the lowering switch valve 32 of the present embodiment. Further, the same advantages as the present embodiment are obtained as a hydraulic control device.

A technical idea that may be understood from the above embodiment and another example is described below.

(a) The controller restricts the output torque of the motor when solely performing the lowering operation and does not restrict the output torque when simultaneously performing the lowering operation and a further operation.

The invention claimed is:

1. A hydraulic control device for a forklift comprising:

a plurality of hydraulic mechanisms, wherein the hydraulic mechanisms include a lifting/lowering hydraulic cylinder that lifts and lowers a fork by supplying and discharging hydraulic oil in accordance with an operation of a lifting/lowering instruction member, and a tilting hydraulic cylinder that tilts a mast, on which the fork is mounted, by supplying and discharging hydraulic oil in accordance with an operation of a tilting instruction member;

a hydraulic pump;

an electric motor that drives the hydraulic pump;

a discharge control mechanism arranged between the lifting/lowering hydraulic cylinder and the hydraulic pump, wherein the discharge control mechanism allows hydraulic oil to be discharged from the lifting/lowering hydraulic cylinder to the hydraulic pump when lowering the fork and stops the discharge of hydraulic oil from the lifting/lowering hydraulic cylinder to the hydraulic pump when stopping or lifting the fork;

a proportional valve arranged between the discharge control mechanism and a drain;

a flow rate control valve arranged between the discharge control mechanism and the drain, wherein the flow rate control valve opens at an open degree that is in accordance with a pressure difference between a front side and a rear side of the proportional valve; and a controller that controls and drives the electric motor, wherein when the lifting/lowering hydraulic cylinder performs a lowering operation of the fork and a hydraulic mechanism other than the lifting/lowering hydraulic cylinder simultaneously performs a further operation, the controller controls an open degree of the proportional valve in accordance with a rotation speed difference of a required lowering operation rotation speed for the hydraulic pump, which is required to perform the lowering operation at an instructed speed that is in accordance with an operation amount of the lifting/lowering instruction member, and a required further operation rotation speed for the hydraulic pump, which is required to perform the further operation.

2. The hydraulic control device for a forklift according to claim 1, wherein when performing the lowering operation simultaneously with a plurality of further operations which includes the further operation, the controller controls the open degree of the proportional valve in accordance with a rotation speed difference between the required lowering operation rotation speed and a maximum rotation speed of required further operation rotation speeds, which is required to perform the respective plurality of further operations.

3. The hydraulic control device for a forklift according to claim 1, wherein when solely performing the lowering operation, the controller controls the open degree of the proportional valve in accordance with a rotation speed difference of the required lowering operation rotation speed and an actual rotation speed of the hydraulic pump.

4. The hydraulic control device for a forklift according to claim 1, wherein the discharge control mechanism is an on/off valve enabling setting of two positions where the on/off valve opens and closes, respectively.

* * * * *